United States Patent [19]

Petterson

[11] Patent Number: 4,530,040

[45] Date of Patent: Jul. 16, 1985

[54] OPTICAL FOCUSING SYSTEM

[75] Inventor: Tor H. Petterson, Palos Verdes Peninsula, Calif.

[73] Assignee: Rayovac Corporation, Madison, Wis.

[21] Appl. No.: 587,619

[22] Filed: Mar. 8, 1984

[51] Int. Cl.[3] ..... F21L 11/00

[52] U.S. Cl. ..... 362/188; 362/268; 362/285; 362/308; 362/311; 362/328

[58] Field of Search ..... 362/157, 187, 188, 268, 362/285, 296, 308, 309, 311, 328, 332

[56] References Cited

U.S. PATENT DOCUMENTS

| | | | |
|---|---|---|---|
| 1,286,590 | 12/1918 | Grether . | |
| 1,463,623 | 7/1923 | McCarthy . | |
| 1,544,236 | 6/1925 | Kahn et al. . | |
| 1,608,195 | 11/1926 | Barany . | |
| 1,647,650 | 6/1928 | Leser . | |
| 1,884,014 | 10/1932 | Loss . | |
| 1,902,377 | 3/1933 | Rosenberg . | |
| 2,099,952 | 11/1937 | Brock | 240/41.3 |
| 2,107,599 | 2/1938 | Chan | 240/10.69 |
| 2,712,060 | 6/1955 | Johnson | 240/61.13 |
| 2,848,601 | 8/1958 | Beach | 240/106.1 |
| 4,214,295 | 7/1980 | Morton . | |
| 4,307,439 | 12/1981 | Sassmannshausen | 362/285 |
| 4,316,241 | 2/1982 | Gulliksen | 362/268 |
| 4,386,391 | 5/1983 | Gulliksen | 362/285 |

*Primary Examiner*—Donald P. Walsh
*Assistant Examiner*—045295771
*Attorney, Agent, or Firm*—Pretty, Schroeder, Brueggemann & Clark

[57] ABSTRACT

An improved optical focusing system is provided which includes a parabolic reflector and a fresnel lens situated with respect to one another to share a common focus point. The improved system is designed to collimate substantially all of the available light emitted from a light source located at the common focus point and project the light along a projecting axis. Depending on the limitations placed upon the size of the parabolic reflector, a retroreflector situated about the periphery of the fresnel lens can be added to the system to maximize the amount of emitted light which the system can process and collimate.

40 Claims, 7 Drawing Figures

3
3

OPTICAL FOCUSING SYSTEM

BACKGROUND OF THE INVENTION

This invention relates generally to optical systems and, more particularly, to an improved optical focusing system for redirecting substantially all of the light rays being emitted from a light source along a single projecting axis to form a high intensity, spotlight-type beam.

To designers and builders of optical focusing systems, it is well known that in many instances it is advantageous to provide a strong, focused beam that can be directed to a relatively small area. Spotlights of all types are an excellent illustration of the usefulness of such beams. On the other hand, there are many circumstances in which a divergent beam of light is particularly desirable. For example, a strong divergent beam of light is often used for nighttime exterior illumination purposes.

The common flashlight is one example of the incorporation of an optical focusing system into an illuminating apparatus. The usual optical focusing system found in a flashlight includes a parabolic reflector which partially surrounds a light bulb. The light bulb is situated generally at the focus of the parabolic reflector so that light emitted from the light bulb is reflected by the parabolic reflector parallel to its principal axis.

Many attempts have been made to modify or vary the construction of ordinary optical focusing systems in an effort to find a more efficient and satisfactory design. For example, one such modification utilizes three reflecting surfaces to substantially surround a light bulb for the purpose of collimating most of the emitted beams of light through a relatively small aperture in one of the reflecting surfaces. In another modified optical focusing system a plurality of reflecting surfaces are associated with a lens to effect a uniform dispersion and diffusion of the light over a predetermined field without sustaining the light losses suffered in prior distributing devices. Also, attempts have been made to design systems for gathering substantially all the light rays from the light source into a projected light beam through the use of one or more reflector/lens combinations.

Such optical focusing systems and illumination devices are subject to several disadvantages and drawbacks, however. One such drawback is the fact that undue complication of the reflector/lens configuration decreases the commercial marketability of the system. Another drawback is that, in spite of various lens and reflector arrangements, an optical focusing system which controls the direction of projection of every available light ray and is capable of collimating substantially all of the available light being emitted from a light source has not been previously devised.

Accordingly, there has been a need for an improved optical focusing system which can collimate substantially all of the light emanating from a light source. The system must be simple to construct, inexpensive, and sufficiently utilitarian so that a device embodying the system could be manipulated to produce either a spotlight-type beam or a divergent beam. Additionally, the improved optical focusing system should be readily adaptable for use as part of a portable illumination device as well as a much larger permanent or semi-permanent lighting installation. The present invention fulfills these needs and provides other related advantages.

SUMMARY OF THE INVENTION

The present invention resides in an improved optical focusing system including a parabolic reflector and a fresnel lens, each situated with respect the other so they share a common focus point. The improved system is designed to collimate substantially all of the available light emitted from a light source when it is located at the common focus point and project the light along a projecting axis. Depending on the limitations placed upon the size of the parabolic reflector, a retroreflector situated about the periphery of the fresnel lens can be added to the system to maximize the amount of emitted light which the system can process and collimate.

In one preferred form, a non-reflective light source support base extends through a parabolic reflector at its vertex and along its principal axis to hold a light source (usually a light bulb) at the focus of the parabolic reflector. A fresnel lens, which has a major diameter substantially equal to the major diameter of the support base, is located opposite the vertex of the parabolic reflector with respect to the light source so that the fresnel lens and the parabolic reflector share a common focus point. When the light source is located at the common focus point, forwardly projecting light is refracted through the fresnel lens and collimated along a projecting axis which generally coincides with the principal axis of the parabolic reflector. Similarly, rearwardly projecting light, which is all of the available non-forwardly projecting light, is reflected from the inner surface of the parabolic reflector and is likewise collimated parallel to the projecting axis. The simultaneous collimation of the forwardly and rearwardly projecting light results in a high intensity, spotlight-type beam.

In another preferred form, a retroreflector is added about the periphery of the fresnel lens. When such an addition is made, the major diameter of the retroreflector is equal to the major diameter of the light source support base and, necessarily, the diameter of an aperture at the vertex of the parabolic reflector through which the support base protrudes. The retroreflector, which is used when the parabolic reflector is not large enough to reflect all of the available rearwardly projecting light, is essentially a spherical segment having an inner reflective surface positioned so that the focus of the retroreflector is either co-located with or situated very near the common focus point. Useful chiefly when the light source is situated at the common focus point, this addition to the improved optical focusing system is necessary for optimal light utilization because it causes light which would otherwise escape between the fresnel lens and the parabolic reflector to be reflected back toward the common focus point to either heat up the light source or be reflected from the parabolic reflector and redirected substantially parallel to the projecting axis.

In both preferred forms, the system can be constructed so that the light source is movable along the principal axis of the parabolic reflector. This feature permits a user to manipulate the positioning of the light source between the parabolic reflector and the fresnel lens in order to move the light source into and out of the common focus point. When the light source is positioned at the common focus point, the emitted light is processed through the improved optical focusing system to create a high intensity spotlight-type beam of collimated rays. However, when the light source is displaced from the common focus point along the principal axis of the parabolic reflector, the beam diverges.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figures 1, 2:
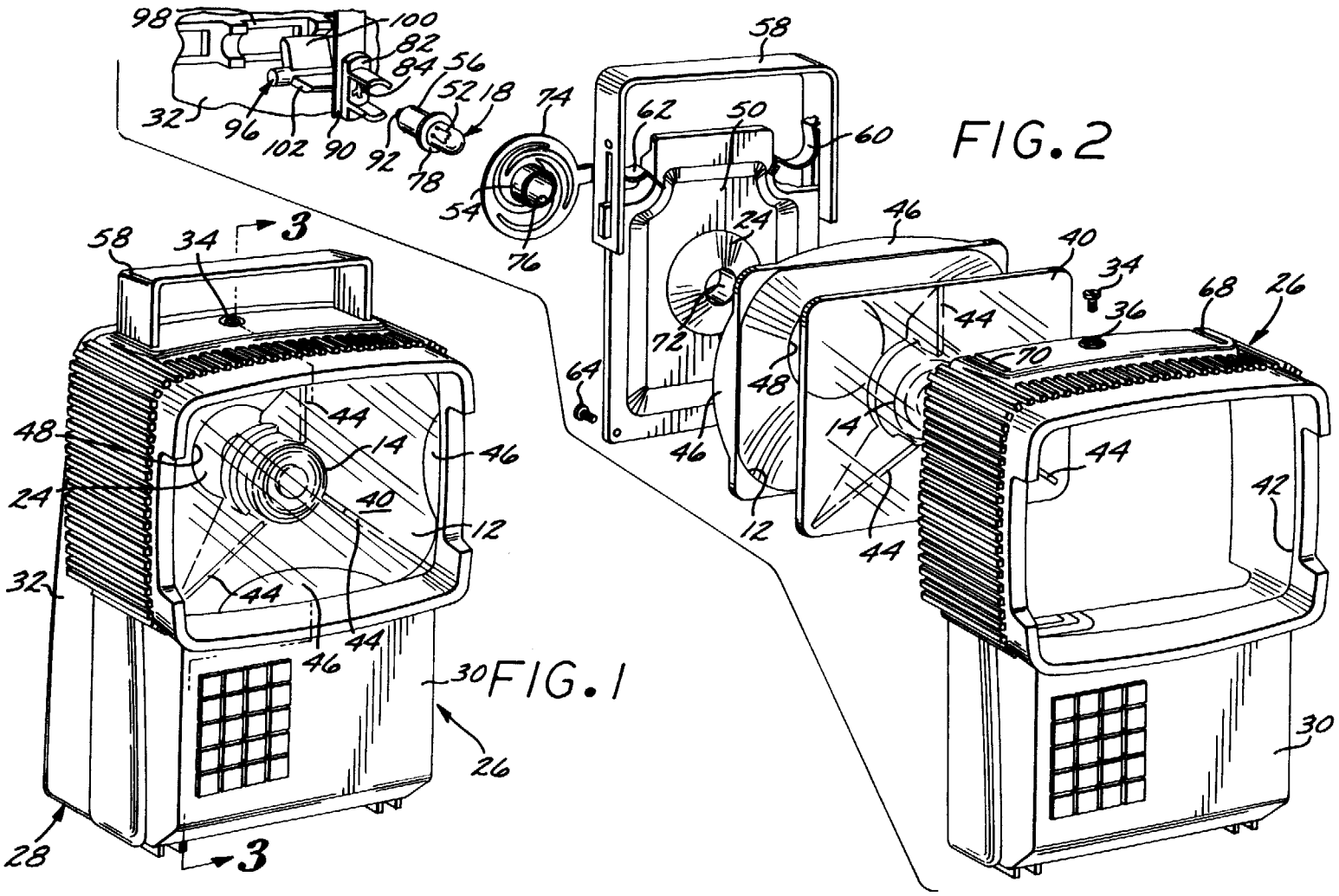
FIG. 1 is a perspective view of a portable light utilizing the improved optical focusing system of the invention.
FIG. 2 is an exploded view of the portable light, illustrating the relationships of the various component parts to one another.

As shown in the drawings for purposes of illustration, the present invention is concerned with an improved optical focusing system, generally designated by the reference number 10, which comprises generally a parabolic reflector 12 and a fresnel lens 14 situated with respect to one another to share a common focus point 16. The improved optical focusing system 10 is capable of collimating substantially all the available light emitted from a light source 18 located at the common focus point 16 and projecting the light along a projecting axis 20. When design constraints limit the size of the parabolic reflector 12, a retroreflector 22 can be added to the improved optical focusing system 10 to maximize the amount of light which can be collimated through the system.

Figure 7:
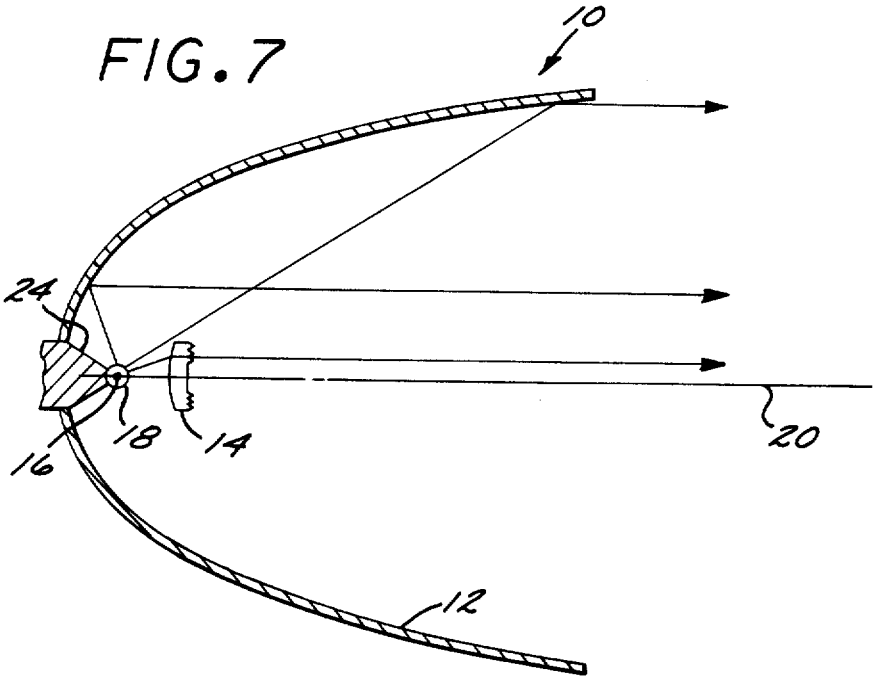
FIG. 7 is a schematic diagram similar to FIG. 6, illustrating the manner in which a fresnel lens and a parabolic reflector can be utilized, without a retroreflector, to collimate substantially all of the available light emitted from a light source and project that light along a single projecting axis.

In one preferred form, best illustrated by FIG. 7, a non-reflective light source support base 24 extends through the vertex of the parabolic reflector 12 along its principal axis to hold the light source 18 (usually a light bulb) at the focus of the parabolic reflector. The fresnel lens 14, which has a major diameter substantially equal to the major diameter of the support base 24, is located opposite the vertex of the parabolic reflector 12 with respect to the light source 18 so that the fresnel lens and the parabolic reflector share a common focus point 16. When the light source 18 is located at the common focus point 16, forwardly projecting light is refracted through the fresnel lens 14 and collimated along the projecting axis 20. This projecting axis 20 generally coincides with the principal axis of the parabolic reflector 12. Similarly, rearwardly projecting light, which is substantially all of the available non-forwardly projecting light emitted by the light source 18, is reflected from the inner surface of the parabolic reflector 12 and is likewise collimated along the same projecting axis 20. The simultaneous collimation of the forwardly and rearwardly projecting light results in a high intensity, spotlight-type beam.

Figure 6:
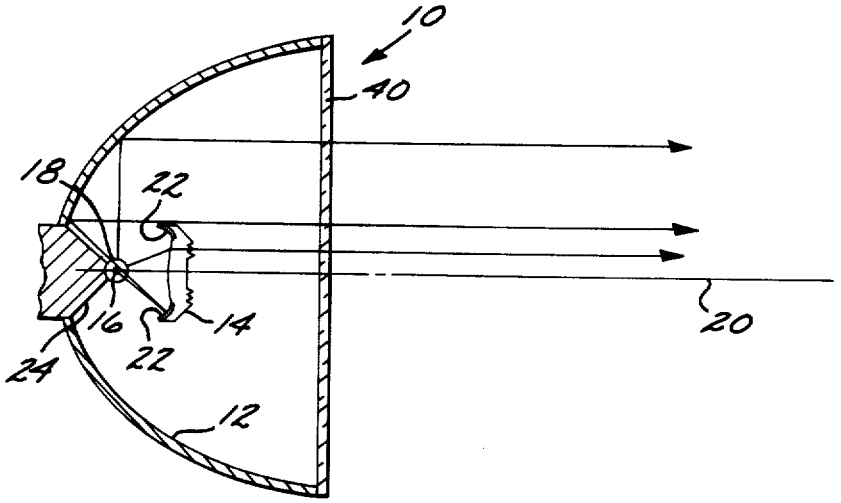
FIG. 6 is a schematic diagram illustrating the manner in which a parabolic reflector, a fresnel lens and a retroreflector cooperate to collimate substantially all of the available light emitted from a light source and project that light along a single projecting axis.

In another preferred form, best illustrated in FIG. 6, the retroreflector 22 is included and situated about the periphery of the fresnel lens 14. The retroreflector 22, which is used when the parabolic reflector 12 is not large enough to reflect all of the available rearwardly projecting light, is essentially a spherical segment having an inner reflective surface positioned so that the focus of the retroreflector is either co-located with or situated very near the common focus point 16. In situations where the focus of the retroreflector 22 is located very near the common focus point 16 rather than co-located with it, it is deemed generally preferable that the focus of the retroreflector be situated between the common focus point and the fresnel lens 14 along the principal axis of the parabolic reflector 12. The retroreflector 22 is necessary for optimal light utilization when the size of the parabolic reflector 12 is limited because the retroreflector causes light which would otherwise escape between the fresnel lens 14 and the parabolic reflector to be reflected back toward the common focus point 16 to either heat up the light source 18 or be reflected from the parabolic reflector and redirected substantially parallel to the projecting axis 20.

The improved optical focusing system 10 is simple to construct, inexpensive and readily adaptable for use as part of a portable illumination device as well as a much larger permanent or semi-permanent lighting installation. Additionally, the system 10 is very utilitarian because a device embodying the system can be designed to allow the light source 18 to be manipulated to produce either a collimated or a divergent beam. This can be accomplished by movably positioning the light source 18 along the principal axis of the parabolic reflector 12 in a manner permitting the selective placement of the light source at the common focus point 16 or at another location displaced from the common focus point. When the light source 18 is positioned at the common focus point 16, the emitted light is processed through the improved optical focusing system 10 to create a high intensity, spotlight-type beam of collimated rays. However, when the light source 18 is displaced from the common focus point 16, the light diverges through the system 10.

In accordance with the present invention, and as illustrated in FIGS. 1 through 5, the optical focusing system 10 has been incorporated into a hand-carried, portable light 26. The outer boundaries of the portable light 26 are defined generally by an outer protective housing 28 which includes an open-faced front component 30 and a complementary rear closure component 32. These two components 30 and 32 of the outer protective housing 28 are designed to be rigidly held together simply by threading a single screw 34 through a pair of cooperating threaded apertures 36 and 38, one in each component, which are located on the top side of each component. A substantially rectangular and transparent face plate 40 fits over a window 42 in the front component 30 to completely enclose and protect, in connection with the open-faced front component and the complementary rear closure component 32 of the outer protective housing 28, the inner parts of the portable light 26.

In addition to protecting portions of the portable light 26, the transparent face plate 40 supports and positions the fresnel lens 14 of the optical focusing system 10. The fresnel lens 14 is suspended in a plane generally parallel to the face plate 40 by three transparent support braces 44 which rigidly position the fresnel lens so that it is centered over the inner side of the face plate. The fresnel lens 14 is of standard construction and it has an optical focus point opposite the face plate 40 so that light impinging upon the fresnel lens from the focus point is collimated by the fresnel lens for projection through the face plate.

The parabolic reflector 12 used in the portable light 26 is not a true paraboloid. The desire to design the light 26 to have a generally rectangular shape, rather than a circular shape, requires the parabolic reflector 12 to include flattened surfaces 46. However, these surfaces 46 do not interfere with the processing of light through the optical focusing system 10. The inner surface of the parabolic reflector 12 is, like the inner surface of the retroreflector 22, highly polished and resembles a mirror. The parabolic reflector 12 is situated in the portable light 26 so that it partially surrounds the fresnel lens 14 and shares a common focus point 16 with the fresnel lens, and so that the open or forward end of the parabolic reflector abuts the face plate 40. In a proper configuration, the vertex of the parabolic reflector 12 is opposite the fresnel lens 14 with respect to the common focus point 16 and the principal axis of the parabolic reflector bisects the fresnel lens.

Since the size and shape of the parabolic reflector 12 incorporated into the portable light 26 is restricted in the illustrated embodiment due to design considerations, the retroreflector 22 is needed to provide optimal light utilization. The retrorereflector 22 is included about the periphery of the fresnel lens 14 simply to prevent light emitted by the light source 18 when situated at the common focus point 16 from escaping between the fresnel lens and the size-restricted parabolic reflector 12 and thereby avoid processing through the optical focusing system 10. The retroreflector 22 causes light impinging upon it which emanated from the common focus point 16 to be reflected back toward the common focus point to either heat-up the light source 18 or become rearwardly projecting light. Subsequently, this retroreflected light can be reflected from the parabolic reflector 12 and redirected substantially parallel to the projecting axis 20. As illustrated in FIG. 7, if the parabolic reflector 12 were sufficiently large enough to reflect all of the available light not refracted through the fresnel lens 14, there would be no need for this retroreflector 22.

A large circular aperture 48 is situated at the vertex of the parabolic reflector 12 and this aperture has a diameter substantially equal to the major diameter of the retroreflector 22 surrounding the fresnel lens 14. In situations where the retroreflector 22 is not needed or used, the diameter of this aperture 48 would approximately equal the major diameter of the fresnel lens 14. The light source support base 24, which is generally part of a backing plate 50, resembles a truncated cone and protrudes through this aperture 48 to support the light source 18. In the illustrated embodiment, the light source 18 is movable through the support base 24 along the principal axis of the parabolic reflector 12 between the fresnel lens 14 and the parabolic reflector.

Figure 3:
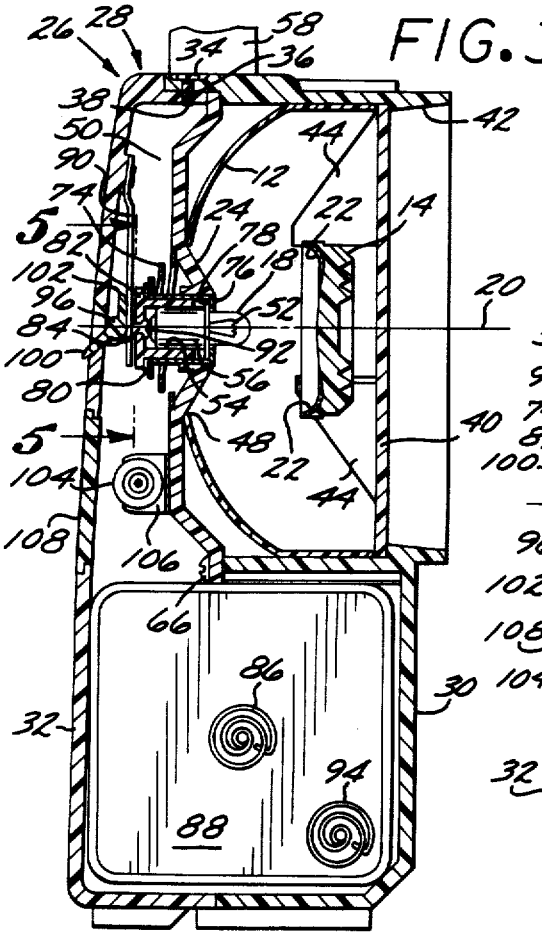
FIG. 3 is an enlarged sectional elevational view taken generally along the line 3—3 of FIG. 1, illustrating the functional location of the various components of the portable light, and, more specifically, the relative orientation of those components comprising the improved optical focusing system.

The light source support base 24 is precisely dimensioned and designed to provide a sturdy and rigid support for the light source 18 while simultaneously not interfering with the collimation of light by the optical focusing system 10. The light source support base 24 is shaped to have a circular base diameter equal to the diameter of the aperture 48 in the vertex of the parabolic reflector 12. As best shown in FIG. 3, when the light source 18 is positioned so that a light source filament 52 is located at the common focus point 16, the upper or forward portion of the truncated cone forming the light source support base 24 is situated adjacent the upper or forward edge of a light source support sleeve 54, and the imaginary top or forward point of the cone is generally co-located with the common focus point.

Besides providing adequate support for the light source 18 and avoiding interference with the processing of light through the optical focusing system 10, the light source support base 24 is designed to actually facilitate optimal light collimation through the system 10. This results from the fact that a defined amount of light is not usable or available for collimation because it is absorbed by a stem 56 of the light source 18 and, possibly, a small portion of the light source support sleeve 54. Assuming that the light emanates from the common focus point 16, the system 10 is designed so that the light rays which first avoid absorption by the light source stem 56 or support sleeve 54 impinge upon the parabolic reflector 12, and not the light source support base 24, at a point adjacent the vertex aperture 48. This non-interfering and nonreflective zone created by the light source support base 24 beneath the light source 18 prevents any stray external rays from being reflected toward the fresnel lens 14 and then being refracted through the fresnel lens in a manner which would uncollimate those rays with respect to light received directly from the common focus point 16.

The backing plate 50, which includes the light source support base 24, supports a handle 58 positionable by two positioning springs 60 and 62 in either a raised carrying configuration or a lowered storage configuration. The upper edge of the backing plate 50 is securely held within a receiving groove in the upper portion of the open-faced front component 30 of the outer protective housing 28, and the lower edge of the backing plate is securely fastened to the same component of the outer protective housing by two screws 64 and 66. When the backing plate 50 is secured to the front component 30, the handle 58 extends through two slots 68 and 70 in the outer protective housing 28.

The light source support sleeve 54 is held within an aperture 72 in the light source support base 24 by a spiraling spring 74. The support sleeve 54 has an inwardly facing flange 76 surrounding the front open edge of the sleeve. This inwardly facing flange 76 interacts with a flange 78 of the light source stem 56 to limit the forward movement of the light source 18 relative to the support sleeve 54. The support sleeve 54 also has an outwardly facing rear flange 80 which interacts with and is connected to the spiraling spring 74. These parts of the portable light 26 are designed and configured so that when the light source 18 is properly positioned within the sleeve 54 and the flange 78 of the light source stem 56 abuts the inwardly facing sleeve flange 76, the light source filament 52 is positioned at the common focus point 16.

An insulating bracket 82 partially covers and is snuggly inserted into the rear portion of the support sleeve 54. An electrical contact 84 runs through this insulating bracket 82 to allow one terminal 86 of a power source 88 enclosed within the outer protective encasement 28, such as a battery, to be connected to the light source 18. Typically this electrical connection between the light and power sources 18 and 88 is in the form of a metallic strip 90 which physically connects the first terminal 86 of the power source to a rear contact point 92 of the light source through the electrical contact 84. In a typical configuration utilizing a common light bulb 18 and a two-pole battery 88, light will emanate from the light bulb filament 52 only when a second terminal 94 of the battery grounds the light bulb and thereby completes the electrical circuit. The spiraling spring 74 and the support sleeve 54 provide a portion of the required grounding mechanism.

Figure 4:
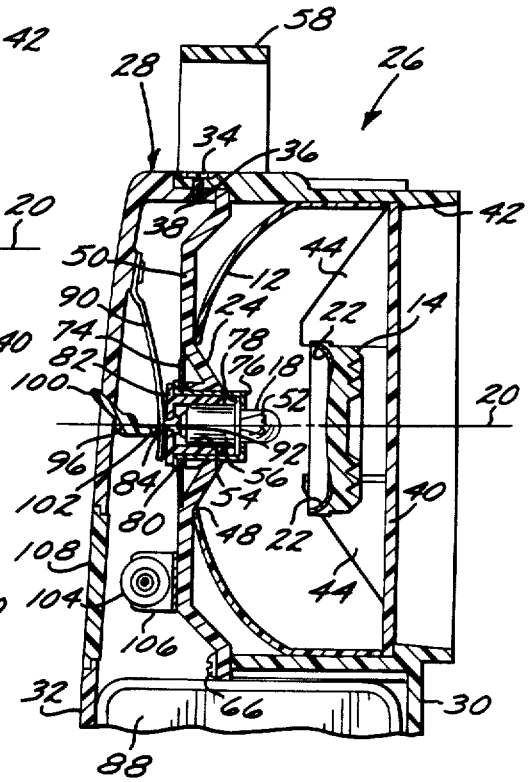
FIG. 4 is a fragmentary sectional elevational view similar to that illustrated in FIG. 3, illustrating a light source in a "forward" position, after having been displaced along the principal axis of a parabolic reflector toward a fresnel lens.
Figure 5:
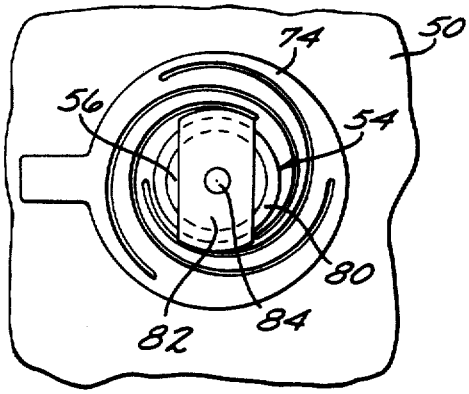
FIG. 5 is an enlarged fragmentary elevational view taken generally along the line 5—5 of FIG. 3, illustrating principally a spring-like contact which positions the light source at a common focus point of the parabolic reflector and the fresnel lens.

Additionally, the electrical connection arrangement between the light source 18 and the power source 88 permits the simultaneous and equal movement, with respect to the support base 24, of the light source, the insulating bracket 82 and the support sleeve 54 with the effect of causing the filament 52 to move along the principal axis of the parabolic reflector 12 out of the common focus point 16 while remaining connected to the power source. This movement is caused by a manually operated lever 96 which is pivotally mounted to a bracket 98 on the inside of the rear closure component 32 and which has a trigger 100 outside the outer protective housing 28. This non-electrically conducting lever 96 simply rests against the metallic strip 90 connecting the light source 18 to the power source 88, without applying any appreciable force on the strip, when the filament 52 is located at the common focus point 16 (FIG. 3). However, as the lever 96 is pivoted, the metallic strip 90 is forced to move away from the rear closure component 32 of the outer protective housing 28 by an extended tongue 102 of the lever. The metallic strip 90 in turn forces the insulating bracket 82, the support sleeve 54 and the light source 18 to simultaneously move generally forwardly along the principal axis of the parabolic reflector 12, resulting in the displacement of the filament 52 from the common focus point 16 (FIG. 4).

When the filament 52 is so displaced from the common focus point 16, light emanating from the light source 18 is no longer collimated by the optical focusing system 10. Instead, the emitted light diverges through the system 10. As the lever 96 is pivoted back to its initial position, the sprialing spring 74 forces the insulating bracket 82, the support sleeve 54 and the light source 18 back to their initial positions and the filament 52 is once again located at the common focus point 16.

Finally, the portable light 26 features a flasher 104 held rigidly in place rearward of the backing plate 50 by a flasher mount 106. This flasher 104 is connected to the power source 88 in a manner allowing its selective activation by the operator. The flasher 104 is designed to illuminate a translucent window 108 in the rear closure component 32 of the outer protective housing 28 sufficiently to create a type of warning beacon. The flasher 104 does not interact with the optical focusing system 10.

From the foregoing, it is to be appreciated that the improved optical focusing system 10 provides a means whereby substantially all the available light being emitted by a light source 18 can be collimated generally along a single projecting axis 20 to form a high intensity, spotlight-type beam. The illustrated portable light 26 can be manipulated to diverge the beam, when desired, by simply moving the light source 18 along the principal axis of the parabolic reflector 12 between the parabolic reflector and the fresnel lens 14 and out of the common focus point 16. It should be understood, however, that the improved optical focusing system 10 is not limited to the illustrated embodiment. For example, if an enlarged parabolic reflector 12 were utilized, there would be no need to include a retroreflector 22 to intercept light rays which would otherwise escape between the fresnel lens 14 and the parabolic reflector. Additionally, the removal of certain design constraints would obviate the necessity of including the several flattened surfaces 46 on the parabolic reflector 12.

Although a particular form of the invention has been illustrated and described, it will be apparent that various modifications can be made without departing from the spirit and scope of the invention. Accordingly, it is not intended that the invention be limited, except as by the appended claims.

I claim:

1. A portable light capable of collimating substantially all of the available light being emitted by a light source along a projecting axis, said portable light comprising:

a protective encasement;

an optical focusing system housed in said protective encasement, said system comprising:

a parabolic reflector which partially surrounds the light source in a manner permitting the light source to be located at the optical focus point of said parabolic reflector, a fresnel lens, situated opposite the vertex of said parabolic reflector with respect to the light source, said fresnel lens sharing a common focus point with said parabolic reflector and being oriented to cooperate with said parabolic reflector for the collimation of light emitted at said common focus point along the projecting axis, and means for intercepting light emitted at said common focus point which would otherwise pass between said parabolic reflector and the outer periphery of said fresnel lens and for reflecting the intercepted light back generally toward said common focus point;

a portable power source which causes the emission of light from the light source; and means for selectively connecting and disconnecting said power source and the light source.

2. A portable light according to claim 1 wherein said parabolic reflector includes an aperture centered at its vertex through which the light source extends.

3. A portable light according to claim 1 including a support base which extends through the vertex of said parabolic reflector to support the light source at said common focus point of said parabolic reflector and said fresnel lens.

4. A portable light according to claim 3 wherein said support base has a major diameter equal to a major diameter of said intercepting means.

5. A portable light according to claim 3 wherein said support base comprises a non-reflective, truncated cone with the base of said cone having a major diameter equal to a major diameter of said intercepting means and the imaginary top point of said cone being generally co-located with said common focus point.

6. A portable light according to claim 3 including means for moving the light source along the principal axis of said parabolic reflector between said fresnel lens and said parabolic reflector.

7. A portable light according to claim 6 wherein the light source can be selectively moved into and out of said common focus point to cause the light being emitted by the light source and processed through said optical focusing system to produce, respectively, a collimated and an uncollimated beam.

8. A portable light according to claim 1 wherein said intercepting means comprises an inwardly facing reflective surface with a curvature approximating that of a portion of a sphere and having its focus either co-located with or situated very near said common focus point.

9. An optical focusing system capable of collimating substantially all of the available light being emitted generally from a single point for projection along a projecting axis, said system comprising:

a parabolic reflector;

means for emitting light at the focus of said parabolic reflector;

a fresnel lens, situated opposite the vertex of said parabolic reflector with respect to said emitting means, said fresnel lens sharing a common focus point with said parabolic reflector and being oriented to cooperate with said parabolic reflector for the collimation of light emitted at said common focus point along the projecting axis; and means for intercepting light emitted at said common focus point which would otherwise pass between said parabolic reflector and the outer periphery of said fresnel lens and for reflecting the intercepted light back generally toward said common focus point.

10. A system according to claim 9 wherein said parabolic reflector includes an aperture centered at its vertex through which said emitting means extends.

11. A system according to claim 9 wherein said emitting means comprises a support base which extends through the vertex of said parabolic reflector and a light source positioned by said support base at said common focus point of said parabolic reflector and said fresnel lens.

12. A system according to claim 11 wherein said support base has a major diameter equal to a major diameter of said intercepting means.

13. A system according to claim 11 wherein said support base comprises a non-reflective, truncated cone with a base of said cone having a major diameter equal to a major diameter of said intercepting means and the imaginary top point of said cone being generally co-located with said common focus point.

14. A system according to claim 11 including means for moving said light source along the principal axis of said parabolic reflector between said fresnel lens and said parabolic reflector.

15. A system according to claim 9 wherein said intercepting means comprises an inwardly facing reflective surface with a curvature approximating that of a portion of a sphere and having its focus either co-located with or situated very near said common focus point.

16. An illumination apparatus capable of collimating substantially all of the available light being emitted by a light source along a projecting axis, said apparatus comprising:

a protective encasement;

an optical focusing system housed in said protective encasement, said system comprising:

a parabolic reflector which partially surrounds the light source in a manner permitting the light source to be located at the focus point of said parabolic reflector, such that light emitted by the light source and impinging directly on the reflector is collimated along the projecting axis, and a fresnel lens, situated opposite the vertex of said parabolic reflector with respect to the light source, said fresnel lens sharing a common focus point with said parabolic reflector such that light emitted by the light source and impinging directly on the lens is collimated along the projecting axis; and a power source which can be selectively connected to the light source.

17. An apparatus according to claim 16 wherein said parabolic reflector includes an aperture centered at its vertex through which the light source extends.

18. An apparatus according to claim 16 including a support base which extends through said parabolic reflector at its vertex to support the light source at said common focus point of said parabolic reflector and said fresnel lens.

19. An apparatus according to claim 18 wherein said support base has a major diameter equal to a major diameter of said fresnel lens.

20. An apparatus according to claim 18 wherein said support base comprises a non-reflective, truncated cone with the base of said cone having a major diameter equal to a major diameter of said fresnel lens and the imaginary top point of said cone being generally co-located with said common focus point.

21. An apparatus according to claim 18 including means for moving the light source along the principal axis of said parabolic reflector between said fresnel lens and said parabolic reflector.

22. An apparatus according to claim 21 wherein the light source can be selectively moved into and out of said common focus point to cause the light being emitted by the light source and processed through said optical focusing system to produce, respectively, a collimated and an uncollimated beam.

23. An apparatus according to claim 16 including means for intercepting light emitted at said common focus point which would otherwise pass between said parabolic reflector and the outer periphery of said fresnel lens and for reflecting the intercepted light back generally toward said common focus point.

24. An apparatus according to claim 23 wherein said intercepting means comprises an inwardly facing reflective surface with a curvature approximating that of a portion of a sphere and having its focus either co-located with or situated very near said common focus point.

25. An apparatus according to claim 16 wherein said encasement includes a transparent, protective face plate which permits light processed by said optical focusing system to pass therethrough without distortion.

26. An optical focusing system capable of collimating substantially all of the available light being emitted generally from a single point for projection along a projecting axis, said system comprising:

a parabolic reflector;

means for emitting light at the focus of said parabolic reflector, such that light impinging directly on the reflector is collimated along the projecting axis; and a fresnel lens, situated opposite the vertex of said parabolic reflector with respect to said emitting means, said fresnel lens sharing a common focus point with said parabolic reflector such that light impinging directly on the lens is collimted along the projecting axis.

27. A system according to claim 26 wherein said parabolic reflector includes an aperture centered at its vertex through which said emitting means extends.

28. A system according to claim 26 wherein said emitting means comprises a support base which extends through the vertex of said parabolic reflector and a light source positioned by said support base at said common focus point of said parabolic reflector and said fresnel lens.

29. A system according to claim 28 wherein said support base has a major diameter equal to a major diameter of said fresnel lens.

30. A system according to claim 28 wherein said support base comprises a non-reflective, truncated cone with the base of said cone having a major diameter equal to a major diameter of said fresnel lens and the imaginary top point of said cone being generally co-located with said common focus point.

31. A system according to claim 28 including means for moving said light source along the principal axis of said parabolic reflector between said fresnel lens and said parabolic reflector.

32. A system according to claim 26 including means for intercepting light emitted at said common focus point which would otherwise pass between said parabolic reflector and the outer periphery of said fresnel lens and for reflecting the intercepted light back generally toward said common focus point.

33. A system according to claim 32 wherein said intercepting means comprises an inwardly facing reflective surface with a curvature approximating that of a portion of a sphere and having its focus either co-located with or situated very near said common focus point.

34. A portable light capable of collimating substantially all of the available light being emitted by a light source along a projecting axis, said portable light comprising:

a protective encasement;

an optical focusing system housed in said protective encasement, said system comprising:

a parabolic reflector which partially surrounds the light source in a manner permitting the light source to be located at the optical focus point of said parabolic reflector, said parabolic reflector including an aperture centered at its vertex through which the light source extends, a fresnel lens, situated opposite the vertex of said parabolic reflector with respect to the light source, said fresnel lens sharing a common focus point with said parabolic reflector and being oriented to cooperate with said parabolic reflector for collimation of light emitted at said common focus point along the projecting axis, and means for intercepting light emitted at said common focus point which would otherwise pass between said parabolic reflector and the outer periphery of said fresnel lens and for reflecting the intercepted light back generally toward said common focus point, said intercepting means including an inwardly facing reflective surface with a curvature approximately that of a portion of a sphere and having its focus either co-located with or situated very near said common focus point;

a support base which extends through the vertex of said parabolic reflector to support the light source at said common focus point, said support base including a non-reflective, truncated cone with the base of said cone having a major diameter equal to a major diameter of said intercepting means and the imaginary top point of said cone being generally co-located with said common focus point;

means for moving the light source along the principal axis of said parabolic reflector between said fresnel lens and said parabolic reflector;

a portable power source which causes the emission of light from the light source; and means for selectively connecting and disconnecting said power source and the light source.

35. A method of collimating substantially all the available forwardly and rearwardly projecting light being emitted from a light source along a single projecting axis, the steps comprising:

collimating substantially all the forwardly projecting light along the projecting axis by refracting it through a fresnel lens; and collimating substantially all the available rearwardly projecting light along the same projecting axis by reflecting it from a parabolic reflector.

36. A method according to claim 35 including the step of reflecting back that portion of the rearwardly projecting light which would escape between said parabolic reflector and said fresnel lens toward the light source when the light source is situated at a common focus point between said parabolic reflector and said fresnel lens.

37. A method of selectively illuminating an area adjacent a light source, the steps comprising:

situating a fresnel lens with respect to a parabolic reflector so that said fresnel lens and said parabolic reflector share a common focus point and a common projecting axis which generally follows the principal axis of said parabolic reflector;

interposing the light source between said fresnel lens and said parabolic reflector;

causing the light source to be positioned at said common focus point when a substantially collimated beam of light is desired; and moving the light source away from said common focus point when an uncollimated beam of light is desired.

38. A method according to claim 37 including the step of collimating substantially all of the forwardly projecting light along said common projecting axis by refracting it through said fresnel lens and collimating substantially all of the available rearwardly projecting light by reflecting it from said parabolic reflector when the light source is positioned at said common focus point.

39. A method according to claim 38 including the step of reflecting a portion of the rearwardly projecting light back toward the light source when the light source is situated at said common focus point between said parabolic reflector and said fresnel lens.

40. A method of collimating substantially all the available light rays being emitted by a light source situated at a common focus point between a parabolic reflector and a fresnel lens, the steps comprising:

providing a light absorption zone about a base of the light source which does not reflect light impinging upon it;

collimating forwardly projecting light from the light source through the fresnel lens along a projecting axis;

retroreflecting light which narrowly misses being refracted through the fresnel lens back toward the light source; and collimating the remainder of all available light rays, including light being retroreflected as well as light directly emitting from the light source, along said projecting axis by reflecting that light from the parabolic reflector which surrounds said light absorption zone so that the light refracted through the fresnel lens and the light reflected by the parabolic reflector unifies to form a single, high intensity beam.

* * * * *